United States Patent [19]

Handa et al.

[11] 4,204,298

[45] May 27, 1980

[54] COMPACT VACUUM CLEANER

[76] Inventors: Hiroyuki Handa; Tomoko Handa, both c/o Sagami Tsushin Kogyo Kabushiki Kaisha Nai, 4041, 5-chome, Nango Chigasaki-shi, Kanagawa-ken, Japan

[21] Appl. No.: 960,999

[22] Filed: Nov. 15, 1978

[30] Foreign Application Priority Data

Nov. 18, 1977 [JP] Japan ..... 52-139159

[51] Int. Cl.[2] ..... A47L 5/24

[52] U.S. Cl. ..... 15/344; 15/346

[58] Field of Search ..... 15/344, 346

[56] References Cited

U.S. PATENT DOCUMENTS

| | | | |
|---|---|---|---|
| 969,441 | 9/1910 | Backer | 15/344 |
| 1,930,778 | 10/1933 | Skidelsky | 15/344 |
| 3,061,959 | 11/1962 | Blumenfeld | 15/346 X |
| 3,484,890 | 12/1969 | Case | 15/346 |

FOREIGN PATENT DOCUMENTS

| | | | |
|---|---|---|---|
| 935807 | 9/1963 | United Kingdom | 15/344 |

*Primary Examiner*—Christopher K. Moore
*Attorney, Agent, or Firm*—Lawrence I. Field

[57] ABSTRACT

An improved compact-type vacuum cleaner is provided. The vacuum cleaner comprises a hollow body member having a closed end and an open end, driving means disposed in said body member, fan means also disposed in said body member and adapted to be driven by said driving means, and duct means also disposed in said body member and adapted to recirculate within said body member an air flow generated by said fan means, said duct means having one end connected to the suction side of said fan means and the other end connected to the discharge side of said fan means.

The vacuum cleaner may further be provided with wiping means attached to the open end of said hollow body member.

17 Claims, 13 Drawing Figures

COMPACT VACUUM CLEANER

BACKGROUND OF THE INVENTION

The present invention relates generally to an improved vacuum cleaner and, in particular, to a compact vacuum cleaner in which the discharge of the air to the outside of the cleaner is diminished as much as possible, so that dust may be collected by the air which is recirculated in the cleaner.

In the conventional vacuum cleaner, the air suspending the collected dust is made to pass through a filter and into a dust collecting sack before it is discharged to the outside of the cleaner. Consequently, most of the collected dust is arrested by the filter and the dust collecting sack. However, the filter and the dust collecting sack cannot arrest invisibly fine particles of dust. As a result, these fine particles are carried away by the air and discharged out of the cleaner together with the air. Consequently, the user is forced to inhale the fine dust into the body during the use of the cleaner. This is quite undesirable from the stand point of sanitation.

This problem is serious especially when the fine dust particles discharged together with the air contains noxious components. In such a case, the user who is engaged in the cleaning inhales the noxious component during the repeated use of the cleaner over a long term, so that the user, especially the respiratory organs of the user may be seriously damaged.

For instance, there is a good deal of chalk dust around the blackboards used in schools. Usually, wipers made of cloth are used to erase the letters and patterns marked on the blackboard by the chalk. As is well known, the chalk dust is scattered when these wipers are used. Consequently, the user of the wiper is forced to inhale the chalk dust, and his respiratory organs are seriously damaged during the repeated use of the wiper. This problem cannot be overcome even by the use of a vacuum cleaner in place of the wiper made of cloth, because the conventional vacuum cleaner cannot prevent the noxious fine chalk dust particles from being released into the ambient air, as stated before.

SUMMARY OF THE INVENTION

Generally speaking, in accordance with the present invention, an improved compact-type electric vacuum cleaner is provided. The vacuum cleaner of the invention comprises a hollow body member having a closed end and an open end, driving means disposed in said hollow body member, fan means disposed in said hollow body member and adapted to be driven by said driving means, and duct means also disposed in said hollow body member and adapted to recirculate therethrough the flow of fluid generated by said fan means, said duct means being connected at its one end to the suction side of said fan means and at its other end to the discharge side of said fan means.

The vacuum cleaner may further be provided with wiping means attached to the open end of said hollow body member, for wiping the dusts.

Accordingly, it is an object of the invention to provide an improved vacuum cleaner.

Another object of the invention is to provide an improved vacuum cleaner wherein the dust particles are never released to the ambient air from the cleaner.

Still another object of the invention is to provide a vacuum cleaner suitable for collecting the chalk dust around a blackboard.

A further object of the invention is to provide a compact vacuum cleaner which can be driven by power supplied from a built-in battery.

A still further object of the invention is to provide a vacuum cleaner having a simple construction and produced at a low cost of production.

Still further objects and advantages of the invention will in part be obvious and will in part be apparent from the present specification. The invention accordingly comprises the features of construction, combination of elements, and arrangements of parts which will be exemplified in the construction hereinafter set forth, and the scope of the invention will be indicated in the claims.

BRIEF DESCRIPTION OF THE DRAWINGS

For a fuller understanding of the invention, reference is made to the following description taken in connection with the accompanying drawings in which.

DESCRIPTION OF THE PREFERRED EMBODIMENT

Figure 1:
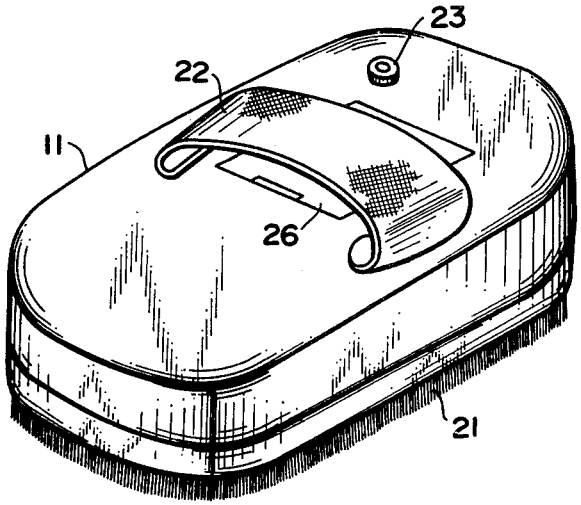
FIG. 1 is a perspective view of a vacuum cleaner constructed in accordance with a preferred embodiment of the invention.
Figure 2:
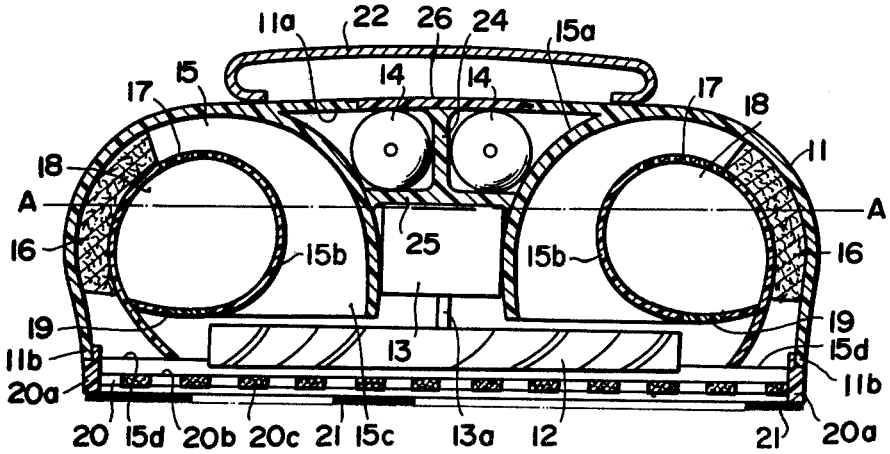
FIG. 2 is a sectional view of the vacuum cleaner of FIG. 1.

FIG. 1 is a perspective view of an embodiment of the invention suitable for use in collecting the chalk dust around a blackboard, while FIG. 2 is a sectional view showing the internal structure of the embodiment as shown in FIG. 1. In these Figures, reference numeral 11 denotes a hollow body member of the cleaner. The hollow body member 11 has a closed end 11*a* and an open end 11*b*. At the lower portion of the hollow body member 11 and in the vicinity of the open end 11*b*, there is mounted an axial fan 12 through a shaft 13*a* of an electric motor 13, for generating a flow of air from the lower to the upper side of the cleaner. The motor 13 is adapted to be supplied with energy from a battery 14. A duct adapted to recirculate the flow of air discharged from the axial fan 12 within the hollow body member 11 is designated by a reference numeral 15. The duct 15 is shaped as illustrated by partitions 15*a*,15*b* disposed in the hollow body member 11. More specifically, the inlet opening 15*c* of the duct 15 faces the discharge side of the axial fan 12, while the outlet opening 15*d* is disposed in the vicinity of the suction side of the axial fan 12. The duct 15 thus envelopes or surrounds the motor 13.

Reference numeral 16 denotes a filter known per se, the fineness of which increases gradually, while reference numeral 17 denotes apertures formed in the partition 15*b*, through which relatively large dust particles are dropped onto a dust collecting sack 18 supported by the partition 15*b*. In order to facilitate the removal of the dust particles accumulated on the bottom of the dust collecting sack 18, a lid 19 is detachably secured to the partition 15*b*.

Figure 3:
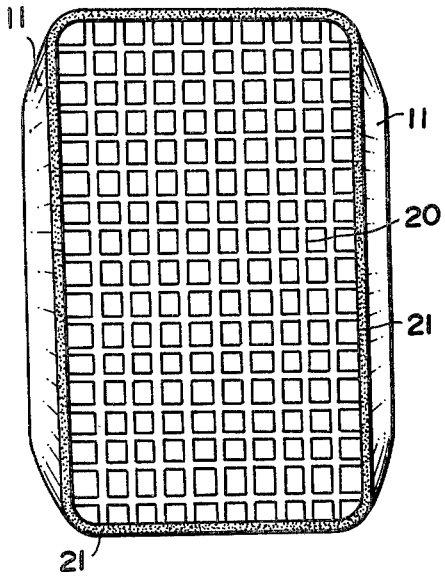
FIG. 3 shows an example of the construction of bottom of the vacuum cleaner of FIG. 1.
Figure 4:
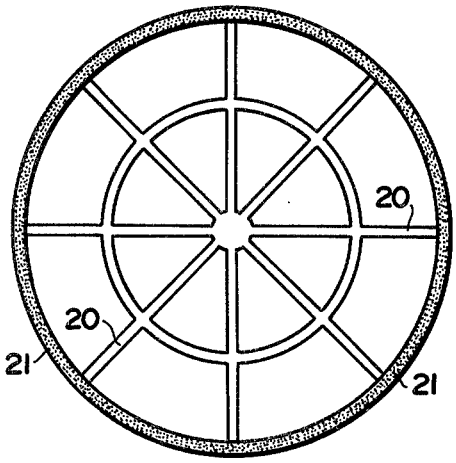
FIG. 4 shows another example of the construction of the bottom of the vacuum cleaner constructed in accordance with another embodiment of the invention.

A wiping member 20 is detachably fixed to a portion of the hollow body member 11 in the vicinity of the open end 11*b*, through an adapter 20*a*, so as to be located just beneath the fan 12. In the described embodiment, the wiping member 20 is constituted by a plate 20*b* and a felt 20*c* overlying the plate 20*b*, and has a grid-like form as shown in FIG. 3. However, in case the cleaner of the invention is formed to have a circular cross-section as shown in FIG. 4, the wiping member may be formed to have radial ribs. Needless to say, the wiping member 20 can have various other shapes.

Detachably attached to the open end 11*b* of the hollow body member 11, is a brush 21 adapted to surround the wiping member 20, so as to substantially insulate the space in the wiping member 20 from the ambient air. The brush may be made of any suitable material, such as synthetic fibers, e.g. nylon, fur or the like. Reference numeral 22 denotes a belt by which the user's hand is retained on the cleaner, while reference numeral 23 designates a switch for controlling the motor 13. The motor 13 and the battery 14 are disposed within spaces defined by partitions 24,25. A lid through which the space housing the battery 14 is accessible for the replacement of the latter is designated by reference numeral 26.

In operation, as the motor 13 is energized, the axial fan 12 is driven to induce the air in a flow of axial direction thereof. Consequently, the air is recirculated through the inlet opening 15*c* of the duct 15, filter 16, outlet opening 15*d* of the duct and then back to the fan 12. Accordingly, the dust particles are suspended by the air and conveyed along the above-mentioned path. Most of the dust particles drop into the dust collecting sack 18, through the apertures 17 formed in the partition 15*b*. Further, most of the dust particles, which have not dropped into the dust collecting sack 18 are caught by the filter 16. The remaining fine particles, which have not been caught by the filter 16 are conveyed to the suction side of the fan 12, through the outlet opening 15*d* of the duct 15, and are circulated until they are caught by the filter 16 or collected in the dust collecting sack 18. The fine dust particles, therefore, are completely prevented from being discharged to the ambient air.

In case the vacuum cleaner of the invention is made to have a circular cross-section, the cleaner may be split into two halves along the line A—A in FIG. 2. These halves are adapted to be detachably coupled to each other by screws. In such a case, the lid 19 as shown in FIG. 2 can be eliminated.

The central portion around which the blades of the fan 12 are disposed does not take part in the recirculation of the air. Therefore, by fixing the wiping member 20 to this central portion, it becomes possible to positively erase the letter or pattern on the blackboard by means of the wiping member.

In use, the user may simply hold the vacuum cleaner with his hand retained by the belt, and press it slightly against the blackboard. In this embodiment, it is advisable to use an electric power supply cord, so that the motor may be supplied with commercially available AC 100 V power, rather than the power from the battery 14, because considerable power is required for erasing the letters and patterns on the blackboard.

In addition, the fan 12 may be a centrifugal fan adapted to induce the air in the direction substantially perpendicular to the axis, rather than an axial fan. In such a case, as will be obvious to those skilled in the art, the duct 15 for the recirculation of the air must have a construction different from that of FIG. 2.

Further, it is possible to use a wiping member 20 made of a finer mesh than that of FIG. 3, e.g. a felt, so that the wiping 20 may also act as a filter and dust collecting sack. In such a case, the filter 16, apertures 17 and the dust collecting sack as shown in FIG. 2 may be dispensed with.

Figure 5:
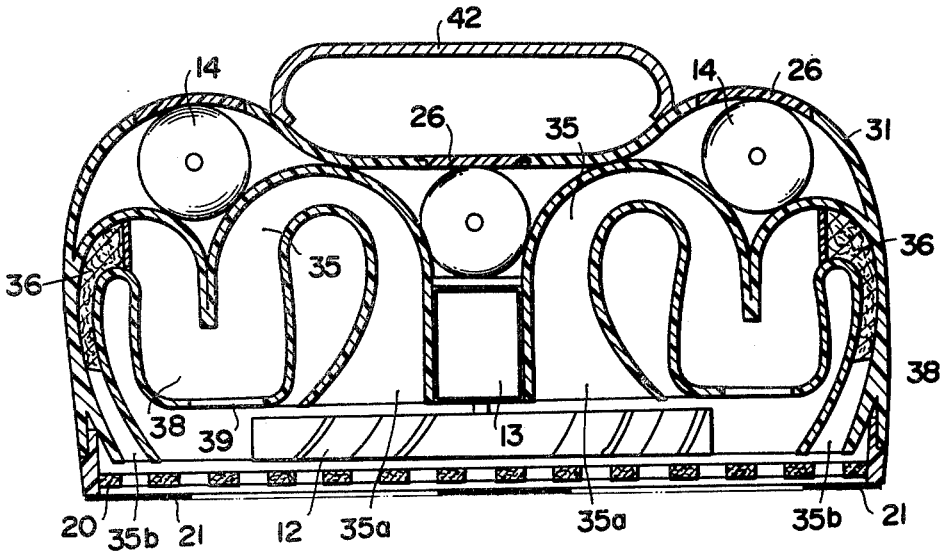
FIG. 5 is a sectional view of a vacuum cleaner constructed in accordance with another embodiment of the invention.

FIG. 5 shows a second embodiment of the invention. In this Figure, reference numerals 12,13,14,20 and 21 denote the same members as those of the first embodiment as shown in FIG. 2. A body member is designated by reference numeral 31. A duct 35 has an inlet opening 35*a* confronting the upper discharge side of the axial fan 12 and an outlet port 35*b* confronting the lower suction side of the axial fan 12, and is adapted to recirculate the air discharged from the latter. The duct 35 has a portion 38 for accumulating the dusts. A lid for allowing the removal of dusts from the portion 38 is designated by reference numeral 39. Also, reference numeral 42 denotes a band by which the user's hand is retained on the cleaner.

This second embodiment differs from the first embodiment in that the duct 35 winds in the form of an M as illustrated, so as to provide the dust accumulating portion 38, and that the battery 14 is disposed in a different way. Other elements than those mentioned specifically above are all identical to those of the first embodiment, so that the detailed description of these element is unnecessary.

Figure 6:
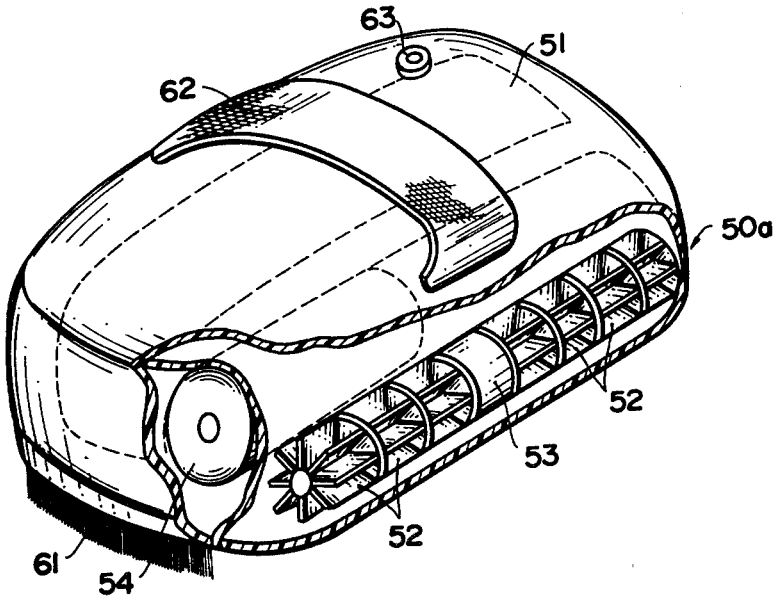
FIG. 6 is a partly sectioned perspective view of a vacuum cleaner constructed in accordance with still another embodiment of the invention.
Figure 7:
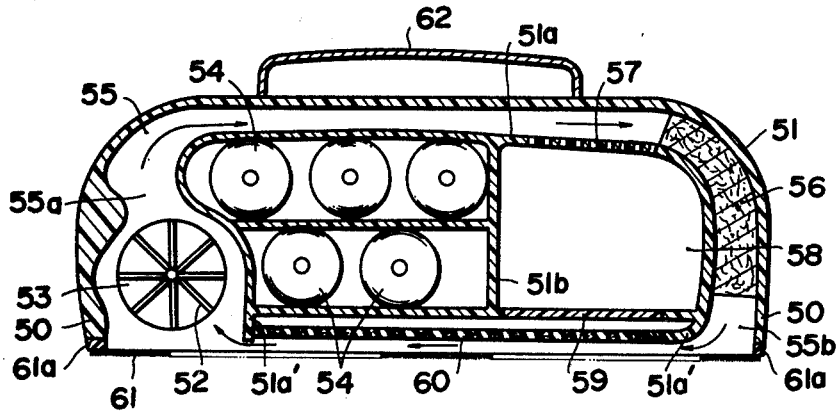
FIG. 7 is a sectional view of the vacuum cleaner constructed in accordance with the embodiment of FIG. 6 of the invention.
Figure 8:
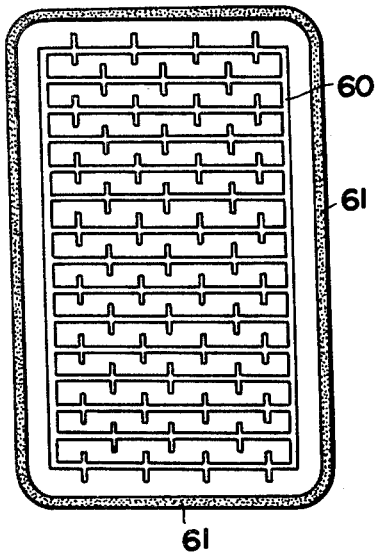
FIGS. 8*a* to 8*d* are schematic illustrations of examples of bottoms of the vacuum cleaner constructed in accordance with the embodiment of FIG. 6 of the invention.
Figure 8:
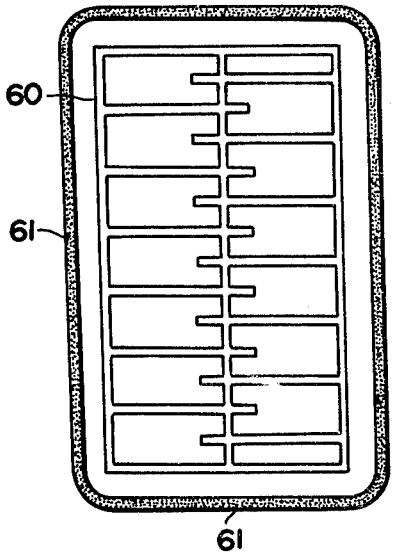
Figure 8:
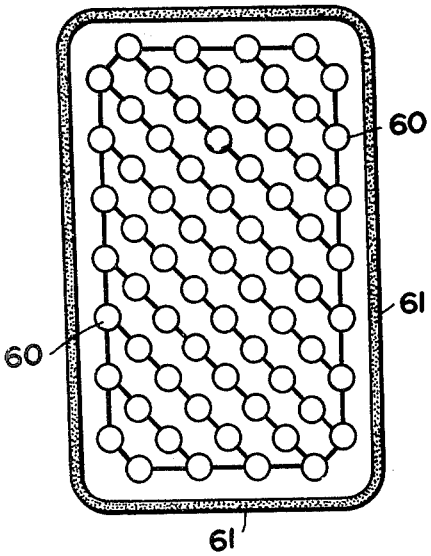
Figure 8:
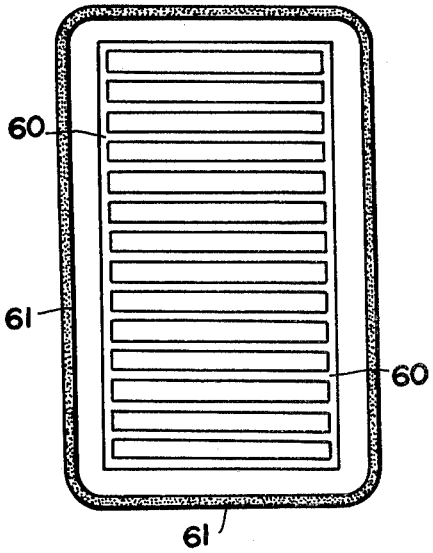

Referring now to FIGS. 6 to 8 showing a third embodiment of the invention, a rotary assembly constituted by horizontal flow fan 52 and a motor 53, which are connected in series to form a cylindrical assembly, is disposed at a corner of the space defined at the lower portion of the body member designated by numeral 51. The construction of the rotary assembly will be most clearly seen from FIG. 6.

In contrast to the axial fans 12 used in the first and second embodiments, the fan 52 of this embodiment is adapted to discharge the air in the direction substantially perpendicular to the axis thereof.

A duct 55 is defined in the body member 51 by a partition 51*a*. The duct 55 has an inlet opening 55*a* and an outlet opening 55*b* which confront, respectively, the upper discharge side and the lower suction side of the fan 52, so as to recirculate the air discharged from the fan 12 through the body member 51. Reference numerals 54,56,57,58 and 59 denote, respectively, a battery, a filter, apertures formed in the partition 51*a* for allowing the dust particles to deposit, a dust collecting sack constituted by partitions 51*a*,51*b* and a lid detachably secured to the bottom of the dust collecting sack 58.

A wiping member 60 is detachably secured to an end 51*a*' of the partition 51*a* which forms the open end of the body member 51. This wiping member is essential for the use of the cleaner of the invention in collecting the chalk dust particles around blackboards. Thus, the wiping member 60 may be dispensed with, when the cleaner is used for ordinary cleaning purpose.

As in the first and second embodiments as shown in FIGS. 2 and 5, a brush 61 is attached to the open end 50 of the body member 51, in a detachable manner by an adapter 61*a*, so as to surround the wiping member 60, thereby to substantially shield the space around the wiping member from the ambient air. Consequently, a passage of air is formed as shown by the arrow in FIG. 7, in the bottom of the cleaner. Reference numerals 62 and 63 denote, respectively, a belt and a switch for controlling the motor.

FIGS. 8*a* to 8*d* show various forms of the wiping member 60 adapted for use in combination with the cleaner of the third embodiment.

In this third embodiment, as the fan 52 is driven by the motor 53, the air is recirculated through the passage which includes the inlet opening 55*a* of the duct 55, duct 55, filter 56, outlet opening 55*b*, wiping member 60 and then the fan 52. The dust particles suspended by the air are conveyed through the above-mentioned passage, and most of these dust particles drops through the apertures 57 formed in the partition 51*a* into the dust collecting sack 58, so as to be stored and accumulated in the latter.

Also, fine dust particles are caught by the filter 56, so that the air discharged from the outlet opening 55*b* of the duct 55 contains almost no particles. Even if a small amount of fine dust particles are contained in the air discharged from the outlet opening, these particles are finally caught by the filter 56 and the dust collecting sack 58, during the repeated circulation of the air, and are never released to the ambient air.

The cleaner of this third embodiment can conveniently have a rectangular shape, which suitable for the cleaning of blackboards.

Also, it will be clear to those skilled in the art that a larger cleaning effect is obtained when a pair of the fan-motor assembly are disposed at respective sides of the body member 51, although only one fan-motor assembly is shown in the illustrated example.

Needless to say, the cylindrical series connection of the fan 52 and the motor 53 as shown in the third embodiment is not required, and the fan may be operatively connected to the motor, which is somewhat spaced from the fan, by means of gears, chain, belt or the like power transmitting means.

Described hereinafter is an embodiment which is intended for use for ordinary cleaning. This embodiment has major features common to the first, second and third embodiments described in connection with FIGS. 2, 5 and 7. The following description therefore is directed only to the features by which this embodiment is differentiated from the preceding three embodiments.

The major points of difference reside in that commercially available electric power is used, in place of the battery, for driving the motor, in order to cope with the demand for the larger power consumption, and in that the wiping member is dispensed with because it is unnecessary.

Figure 9:
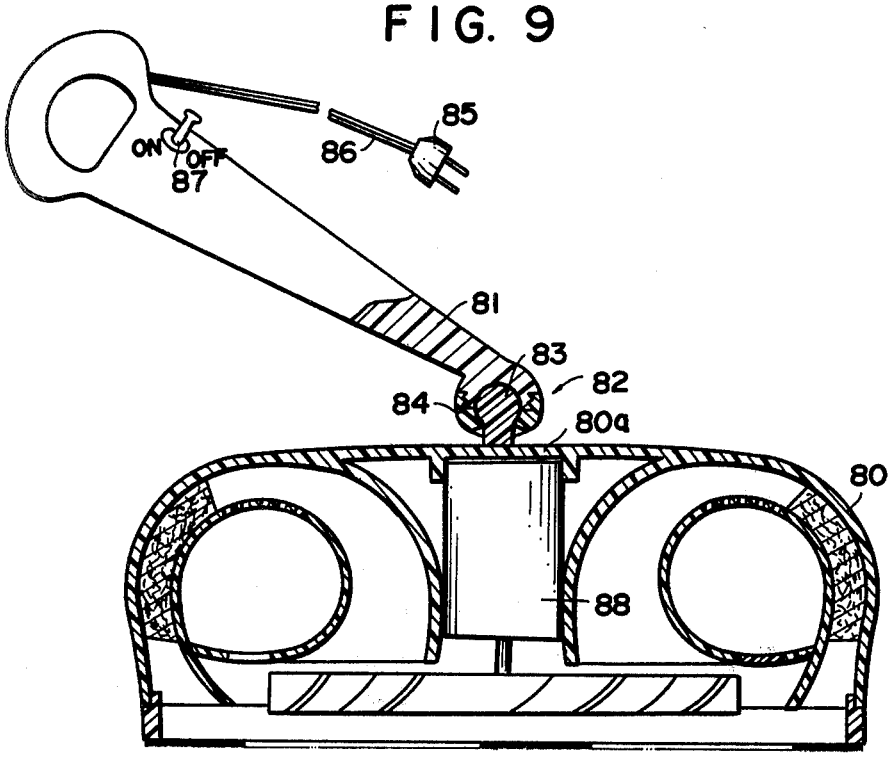
FIG. 9 is a partly sectioned view of a vacuum cleaner constructed in accordance with a further embodiment of the invention.

Referring first to FIG. 9, a body member 80 is mechanically coupled to a handle 81 by means of a joint, for example, a swivel joint 82. The swivel joint is, in this embodiment, secured to the upper portion 80*a* of the body member 80 and includes an inner spherical ball 83 and an outer clamping means 84 which fits snugly over the ball 83. The clamping means 84 is secured to the handle 81 which is designed to be held in the user's hand during the cleaning operation.

In this embodiment, power is derived from an alternating power supply by means of a plug 85 and line 86. Mounted within the handle 81 is an "on and off" switch 87. In addition, a motor 88 of a relatively large power is used to enhance the capacity of the vacuum cleaner. Other features than those specifically mentioned above are substantially identical to those of the first embodiment as shown in FIG. 2, except that the wiping member is not incorporated in this embodiment. For the detail of the construction and operation of this embodiment, reference should be made to FIG. 2 and the description thereof.

Figure 10:
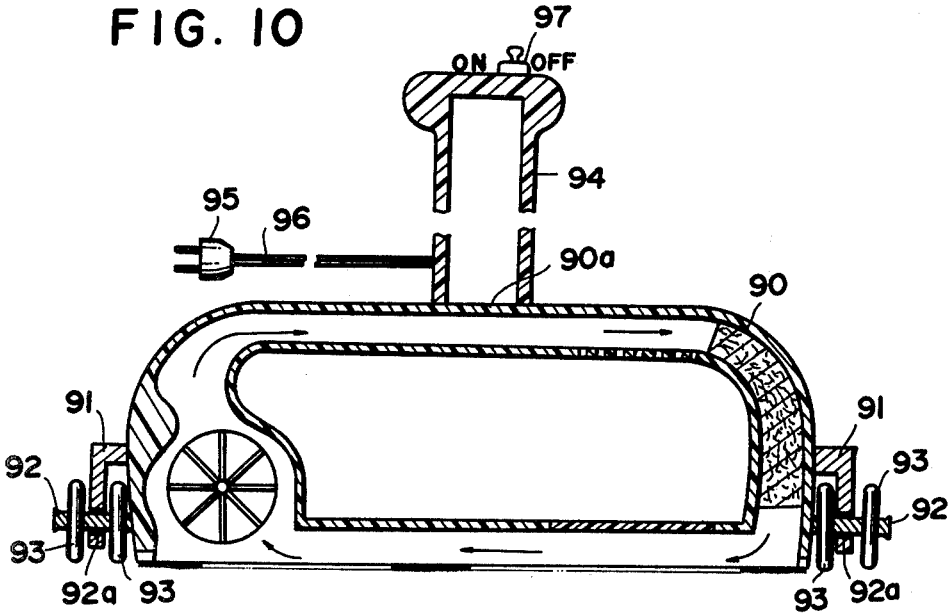
FIG. 10 is a partly sectioned view of a vacuum cleaner constructed in accordance with still another embodiment of the invention.

In the embodiment as shown in FIG. 10, the body member 90 is provided with caster wheels 93, so that the vacuum cleaner may easily be moved along the surface to be cleaned.

More specifically, in the embodiment as shown in FIG. 10, brackets 91 are attached to the body member 90. To each of the brackets 91, there is attached a caster wheel 93 by means of a bearing 92*a* and a shaft 92. A handle 94 is attached to the upper portion 90*a* of the body member 90. The handle 94 is designed to be held in the user's hand during the cleaning operation.

Power is also derived from an alternating power supply by means of a plug 95 and electric cord 96. On the handle 94 there is an "on and off" switch 97. The construction of this embodiment is substantially identical to that of the embodiment as shown in FIG. 7, except the points specifically mentioned above and that the wiping member is dispensed with. For the detail of the construction and operation of this embodiment, reference should be made to FIG. 7.

According to the described construction of the vaccum cleaner of the invention, it is ensured that the flow of air induced by the fan is repeatedly circulated within the body member and is never discharged out of the body member, so that the dust particles suspended by the air are all caught and collected by the filter and the dust collecting sack.

The vacuum cleaner of the invention offers the following advantages. Namely, when the vacuum cleaner of the invention is used for cleaning a blackboard, the harmful scattering of the dust particles around the user is fairly avoided to effectively protect the user's body against the noxious components of the dusts.

In addition, although the vacuum cleaner of the invention is originally intended to overcome the problems inherent in the conventional blackboard cleaner, and has a construction which fulfills this aim, it is to be noted that the vacuum cleaner of the invention can advantageously be used also for ordinary cleaning purposes other than the blackboard cleaning, because the major advantage of the vacuum cleaner derived from the repeated circulation of the dust-suspending air, which prevents the release of noxious component to the outside of the cleaner, is obtained even when the cleaner is used for the ordinary cleaning purposes. Namely, an ordinary vacuum cleaner for general use constructed in accordance with the invention is superior from the view point of sanitation, because it does not release the air suspending fine dust particles.

Further, the recirculation of the air offers another advantage of reduced loss of power, i.e. an improved efficiency.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention hereindescribed and all statements of the scope of the invention which, as a matter of language, might be said to fall therebetween.

What is claimed is:

1. A vacuum cleaner comprising:

a hollow body member having a closed upper end and an open lower end adapted to be disposed so as to apply an air draft to a surface to be claimed;

driving means disposed in said body member;

means connecting said driving means with a source of energy to drive said driving means;

fan means disposed in said body member and adapted to be driven by said driving means; and duct means formed in part by said body member and in part by partitions disposed in said body member and adapted to circulate within said body member an air flow generated by said fan means, said duct means having an outlet end adjacent to a suction side of said fan means and an inlet end confronted by a discharge side of said fan means, a portion of said duct means defining a dust collecting chamber into which dust may pass through openings in the wall of said duct whereby dust may be collected in said chamber and a door through which dust collected in said chamber may be removed.

2. The vacuum cleaner as claimed in claim 1, wherein said fans means is adapted to induce said air flow in the direction of the axis of rotation of said fan.

3. The vacuum cleaner as claimed in claim 1, wherein said fan means is adapted to induce said air flow in a direction substantially perpendicular to the axis of rotation of said fan.

4. The vacuum cleaner as claimed in claim 1, wherein said driving means is a motor operatively connected with said fan means.

5. The vacuum cleaner as claimed in claim 1, further including a wiping means disposed at the open lower end of said hollow body member and adapted for wiping dust.

6. The vacuum cleaner as claimed in claim 5, wherein said wiping means includes a feft member.

7. The vacuum cleaner as claimed in claim 5, including brush member disposed at the open end of said hollow body member and adapted to surround said wiping member so as to substantially shield the space around said wiping member from ambient air when said vacuum cleaner is disposed on said surface to be cleaned.

8. The vacuum cleaner as claimed in claim 7, wherein said hollow body member is provided with a band which is designed to be held in the hand during the cleaning operation.

9. The vacuum cleaner as claimed in claim 1, further including a brush member disposed at the open end of said hollow body member and adapted to shield between an inner side and an outer side of said hollow body member when said vacuum cleaner is disposed on said surface to be cleaned.

10. The vacuum cleaner as claimed in claim 9, wherein said brush member is a brush made of synthetic fiber or fur.

11. The vacuum cleaner as claimed in claim 9, further including a handle designed to be held in the hand during the cleaning operation.

12. The vacuum cleaner as claimed in claim 1, wherein said duct means includes a filter disposed therein.

13. The vacuum cleaner as claimed in claim 12, wherein the fineness of said filter increases gradually toward an outlet of said duct means.

14. The vacuum cleaner as claimed in claim 1, wherein said driving means and said fan means are connected in series to form a cylindrical assembly and disposed at a corner of a space defined at the lower portion of said hollow body member.

15. The vacuum cleaner as claimed in claim 11, wherein said partition is arranged so that said duct means surrounds said driving means.

16. The vacuum cleaner as claimed in claim 1 wherein said partition further includes apertures through which said dust is dropped into said dust collecting chamber.

17. The vacuum cleaner as claimed in claim 1 further including a built-in battery disposed in said hollow body member for energizing said driving means.

* * * * *